United States Patent [19]

Darragh

[11] Patent Number: 5,065,816

[45] Date of Patent: Nov. 19, 1991

[54] SEALING SYSTEM FOR A CIRCULAR HEAT EXCHANGER

[75] Inventor: Charles T. Darragh, San Diego, Calif.

[73] Assignee: Solar Turbines Incorporated, San Diego, Calif.

[21] Appl. No.: 530,954

[22] Filed: May 29, 1990

[51] Int. Cl.[5] ..... F28F 9/00

[52] U.S. Cl. ..... 165/125; 165/82; 165/166; 60/39.511

[58] Field of Search ..... 165/82, 83, 125, 166, 165/9; 60/39.511

[56] References Cited

U.S. PATENT DOCUMENTS

| | | | |
|---|---|---|---|
| 2,594,761 | 4/1952 | Fletcher et al. | 165/83 |
| 3,255,818 | 6/1966 | Beam, Jr. et al. | 165/166 |
| 3,285,326 | 11/1966 | Wosika | 165/4 |
| 3,476,174 | 11/1969 | Guernsey et al. | 165/9 |
| 3,507,115 | 4/1970 | Wosika | 60/39.51 |
| 3,759,323 | 9/1973 | Dawson et al. | 165/166 |
| 3,818,984 | 6/1974 | Nakamura et al. | 165/166 |
| 3,889,744 | 6/1975 | Hill et al. | 165/83 |
| 4,072,327 | 2/1978 | Young | 285/137 |
| 4,098,330 | 7/1978 | Flower et al. | 165/166 |
| 4,474,000 | 10/1984 | Benson et al. | 60/39.511 |

FOREIGN PATENT DOCUMENTS

| | | | |
|---|---|---|---|
| 1211918 | 3/1960 | France | 165/83 |
| 715491 | 9/1954 | United Kingdom . | |
| 1539035 | 1/1979 | United Kingdom . | |
| 2094172 | 9/1982 | United Kingdom . | |

OTHER PUBLICATIONS

Application filed simultaneously herewith by: Charles T. Darragh, For: Circular Heat Exchanger Ser. No. 530,957.

Application filed simultaneously herewith By: Charles T. Darragh, For: Circular Heat Exchanger Having Uniform Cross-Sectional Area Throughout the Passages Therein, 530,955.

Application filed simultaneously herewith By: Charles T. Darragh, For: Thermal Restraint System for a Circular Heat Exchanger, 530,960.

*Primary Examiner*—Allen J. Flanigan

*Attorney, Agent, or Firm*—Larry G. Cain

[57] ABSTRACT

Circular heat exchangers have been used to increase the efficiency of engines by absorbing heat from the exhaust gases and transferring a portion of the exhaust heat to the intake air. The present heat exchanger is built to better seal the cooler recipient fluid from the heated recipient fluid and the donor fluid within the operation of the heat exchanger. The circular heat exchanger is also easily removable from the engine should repair or servicing be required. The manifold is interwoven between the inlet ports and the outlet ports and sealingly separates the cool recipient fluid from the heated recipient fluid. The tongue and groove compensates for the expansion and contraction of the core due to the thermal variations imputed by exhaust from the engine and compensate for such thermal variations.

25 Claims, 9 Drawing Sheets

10
131
126
149
14
166
152
156
164
162
168
102
150
64
82
28
24
160
158
138
140
16
148
132
142
52
144
136
134
146
50
29
20
126
128
18
100
27
26
170
106
80
98
16
12
130
46
60
22
38
44
62

SEALING SYSTEM FOR A CIRCULAR HEAT EXCHANGER

DESCRIPTION

1. Technical Field

This invention relates generally to a heat exchanger and more particularly to the construction of a circular heat exchanger being removably attachable to an engine and being sealed therebetween.

2. Background Art

Many gas turbine engines use a heat exchanger or recuperator to increase the operation efficiency of the engine by extracting heat from the exhaust gas and preheating the intake air. Typically, a recuperator for a gas turbine engine must be capable of operating at temperatures of between about 500° C. and 700° C. and internal pressures of between approximately 450 kPa and 1400 kPa under operating conditions involving repeated starting and stopping cycles.

Such circular recuperators include a core which is commonly constructed of a plurality of relatively thin flat sheets having an angled or corrugated spacer fixedly attached therebetween. The sheets are joined into cells and sealed at opposite sides and form passages between the sheets. These cells are stacked or rolled and form alternative air cells and hot exhaust cells. Compressed discharged air from a compressor of the engine passes through the air cells while hot exhaust gas flows through alternate cells. The exhaust gas heats the sheets and the spacers, and the compressor discharged air is heated by conduction from the sheets and spacers.

An example of such a recuperator is disclosed in U.S. Pat. No. 3,285,326 issued to L. R. Wosika on Nov. 15, 1966. In such a system, the recuperator includes a pair of relatively thin flat plates spaced from an axis and wound about the axis with a corrugated spacer therebetween. The air flow enters one end and exits the opposite end, and the exhaust flow is counter-flow to the air flow entering and exiting at the respective opposite ends. One of the problems with such a system is its lack of efficiency and the inability to inspect or check each passage for leakage prior to final assembly.

Another example of such a recuperator is disclosed in U.S. Pat. No. 3,507,115 issued to L. R. Wosika on July 28, 1967. In such a system, the recuperator comprises a hollow cylindrical inner shell and a concentric outer shell separated by a convoluted separator sheet which is wound over and around several corrugated sheets forming a series of corrugated air cores and combustion gas cores. In order to increase the transfer between the hot gases or cold air, the corrugated sheets are metallically bonded to the separator sheets in an attempt to increase efficiency. One of the problems with such a system is its lack of efficiency and the ability to test or inspect individual passages prior to assembly into a finished heat exchanger. Furthermore, the concentric outer shell is exposed to the recuperator temperatures on one side and to the environmental temperature on the other side. Thus, as the recuperator expands and contracts due to start up and shut down, the thermal stress and strain induced in the core at the point of connection between the convoluted separator sheets, the corrugated sheets and the concentric outer shell will be greatly varied and reduce the longevity of the structure.

Another example of such a recuperator is disclosed in U.S. Pat. No. 3,255,818 issued to Paul E. Beam, Jr. et al, on June 14, 1966. In such a system, a simple plate construction includes an inner cylindrical casing and an outer annular casing having a common axis. Radially disposed plates form passages A and B which alternately flow a cooler fluid and a hotter fluid. A corrugated plate being progressively narrower in width toward the heat exchanger axis is positioned in the passage A and a corrugated plate being progressively increasing in width toward the axis is positioned in the passage B. One of the problems with such a system is its lack of efficiency. Furthermore, the outer annular casing is exposed to the recuperator temperatures on one side and to the environmental temperature on the other side. Thus, as the recuperator expands and contracts due to start up and shut down, the thermal stress and strain induced in the core at the point of connection between the radially disposed plates and the outer casing will be greatly varied and reduce the longevity of the structure.

Another example of a circular recuperator or regenerator is disclosed in U.S. Pat. No. 3,476,174 issued to R. W. Guernsey et al, on Nov. 4, 1969. In such system, a radial flow regenerator includes a plurality of heat transfer segments formed by a number of laid-up thin corrugated sheet metal strips or shims. The segments are mounted between stiffeners, and a bridge is positioned in notches and secured to the segments. Thus, the regenerator, while providing a radial flow, fails to efficiently make use of the entire heat exchange area. For example, the stiffeners and bridges are positioned in an area which could be used for heat transferring purposes. Furthermore, the cost and complexity of the structure is greatly increased because of the notches and complex shapes of the control beams.

Another example of a recuperator structure is disclosed in U.S. Pat. No. 3,889,744 issued to James A. Hill et al, on June 17, 1975. A recuperator structure includes a body and a pair of wall portions. The body is biasingly maintained in alignment by the flexing actions of wall portions. A plurality of support members position the body, and a plurality of seals are disposed between the body and the wall portions. The recuperator while providing seals and a plurality of support members to position the body could be more efficient, less costly and less complex. For example, the supports are extremely complex and a much simpler support is available.

Another example of a heat exchanger construction is disclosed in U.S. Pat. No. 3,759,323 issued to Harry J. Dawson et al, on Sep. 18, 1973. A primary surface plate-type heat exchanger construction is shown and uses a plurality of flat successively stacked sheets having a plurality of edge bars for spacing the sheets apart. A large number of sheets are stacked in pairs with the edge bars therebetween to form a heat exchange core of a desired size.

The present invention is directed to overcome one or more of the problems as set forth above.

DISCLOSURE OF THE INVENTION

In one aspect of the invention, a heat exchanger is adapted for use in an engine which includes an exhaust system having a donor fluid as a part thereof, and an air intake system having a recipient fluid as a part thereof. The heat exchanger includes a core having a plurality of heat recipient passages and a plurality of heat donor passages therein and a housing surrounding the core. The core is removably attachable to the engine, is generally circular and has a central axis. Further included is a means for sealing the donor fluid so that the donor fluid passes through the core, and further seals the recipient fluid prior to entering the core and after passing through the core. The means for sealing is removably attachable between the engine and the core. The means for sealing further includes a tongue and a groove. The groove is formed between a pair of generally concentric cylinder members. One of the tongue and the members is fixedly attached to the core and the other one of the tongue and the members is attached to the engine.

In another aspect of the invention, a heat exchanger is adapted for use in an engine which includes an exhaust system having a donor fluid as a part thereof, an air intake system having a recipient fluid as a part thereof. The heat exchanger includes a core having a plurality of heat recipient passages and a plurality of heat donor passages therein and a housing surrounding the core. The core is removably attachable to the engine, is generally circular and has a central axis. Further included is a means for sealing the donor fluid so that the donor fluid passes through the core, and further seals the recipient fluid prior to entering the core and after passing through the core. The means for sealing is removably attachable in sealing contact between the exhaust system and the core. The means for sealing further includes a manifold having an end fixedly attached to the core, positioned between the housing and the core and the other end removably attachable in sealing contact between the housing and the core.

In another aspect of the invention, a seal is adapted for use in an engine having a heat exchanger wherein the heat exchanger includes a core. The engine has an air intake system having a recipient fluid therein and having a plurality of inlet ports through which the recipient fluid passes and a plurality of outlet ports through which the recipient fluid passes. The inlet and outlet ports are alternately positioned in a generally circular band. The seal has a continuous closed loop configuration, is removably positioned between the engine and the heat exchanger and is interwoven between the plurality of inlet and outlet ports.

BEST MODE FOR CARRYING OUT THE INVENTION

Figure 1:
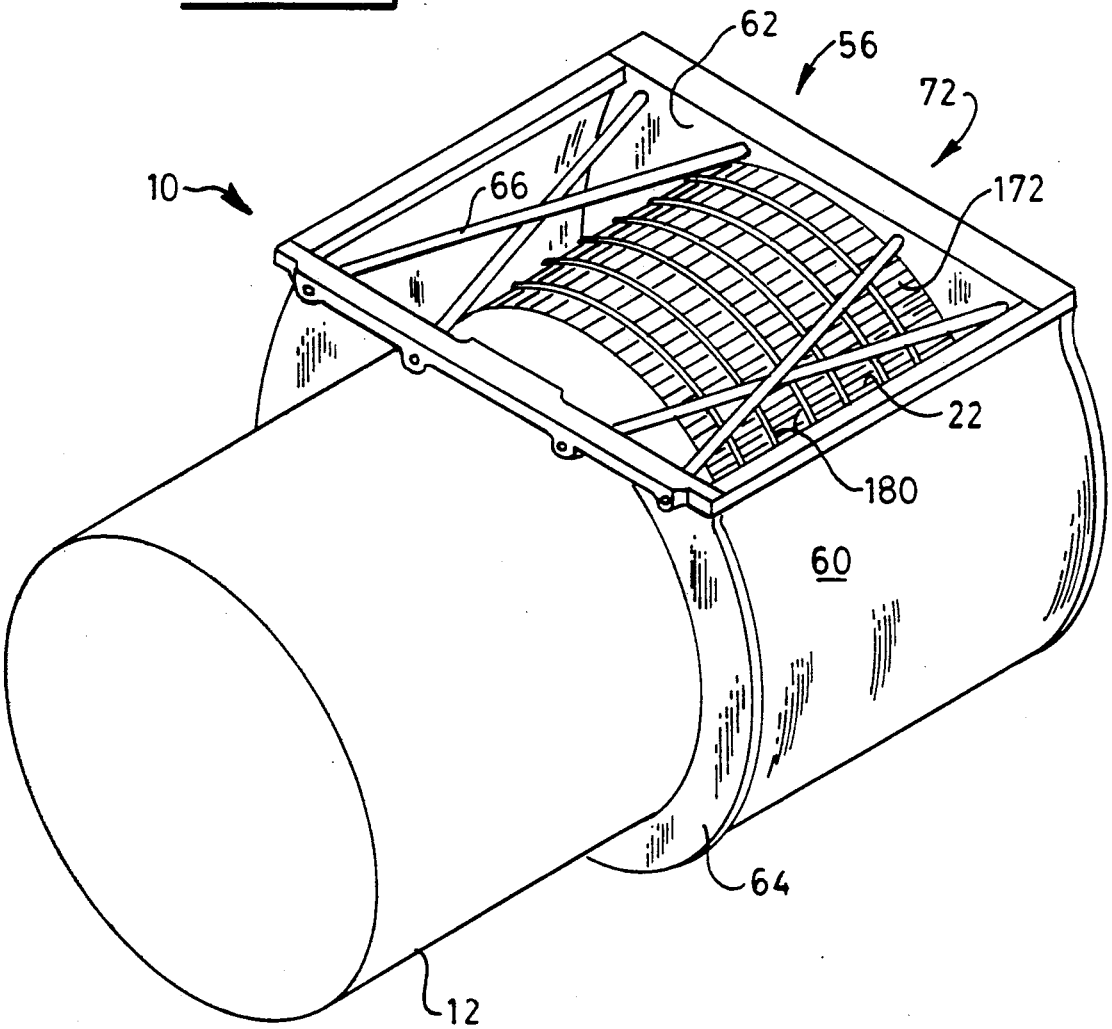
FIG. 1 is a perspective view of a portion of an engine adapter for use with an embodiment of the present invention.
Figure 2:
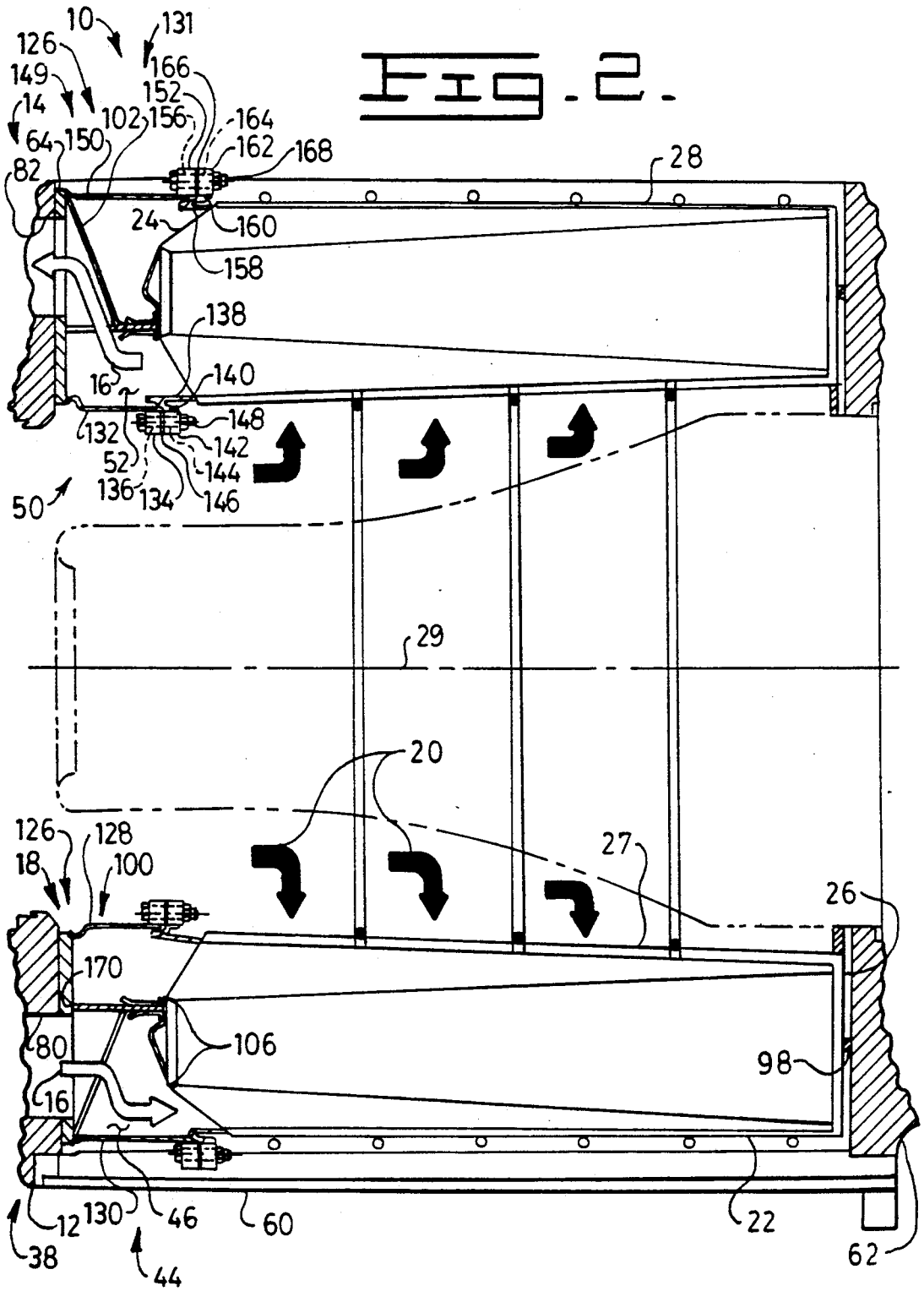
FIG. 2 is a sectional view of a heat exchanger and a portion of the engine.
Figure 2A:
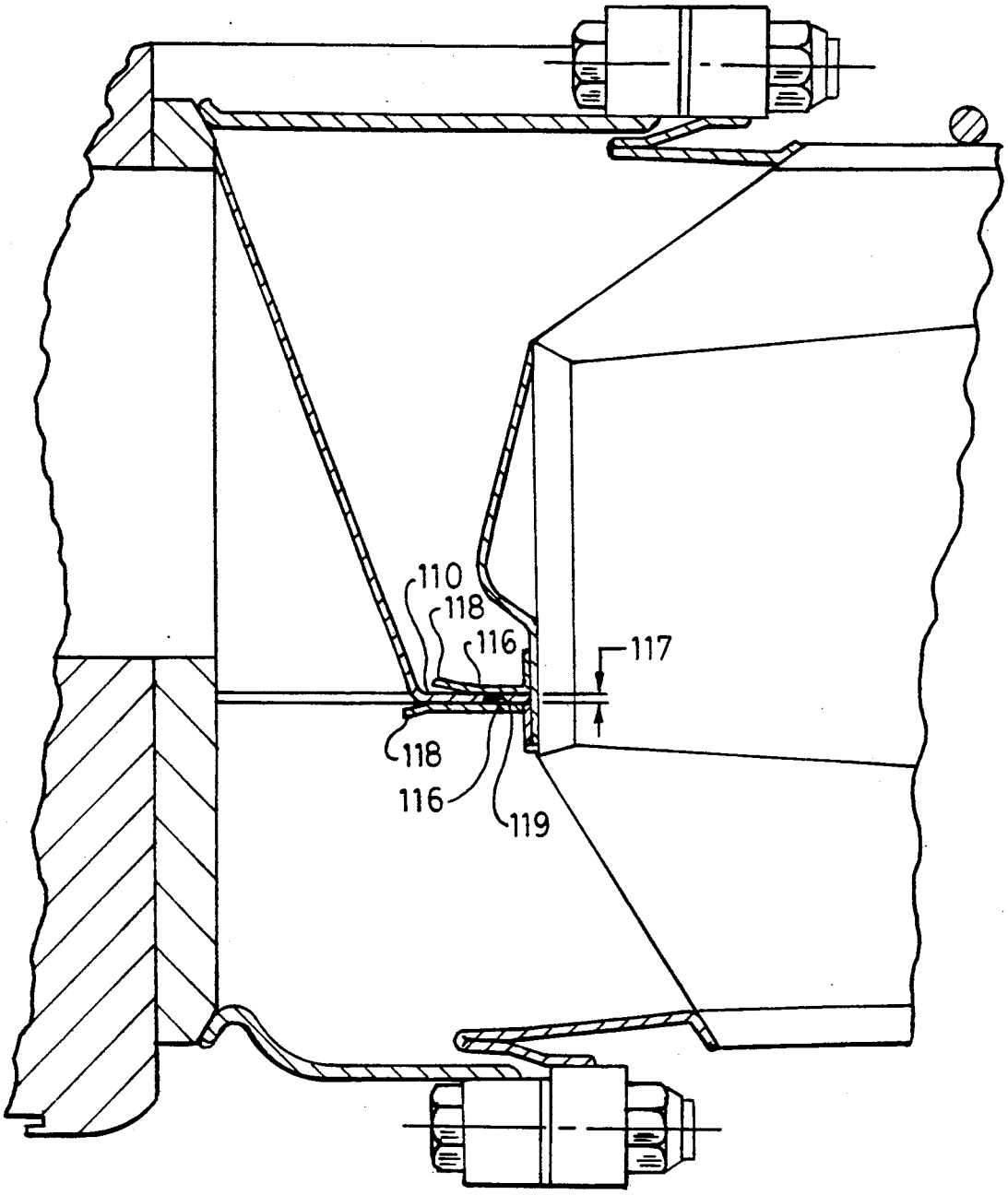
FIG. 2A is an enlarged cross-sectional view of an embodiment of an inner sealing portion.
Figure 5:
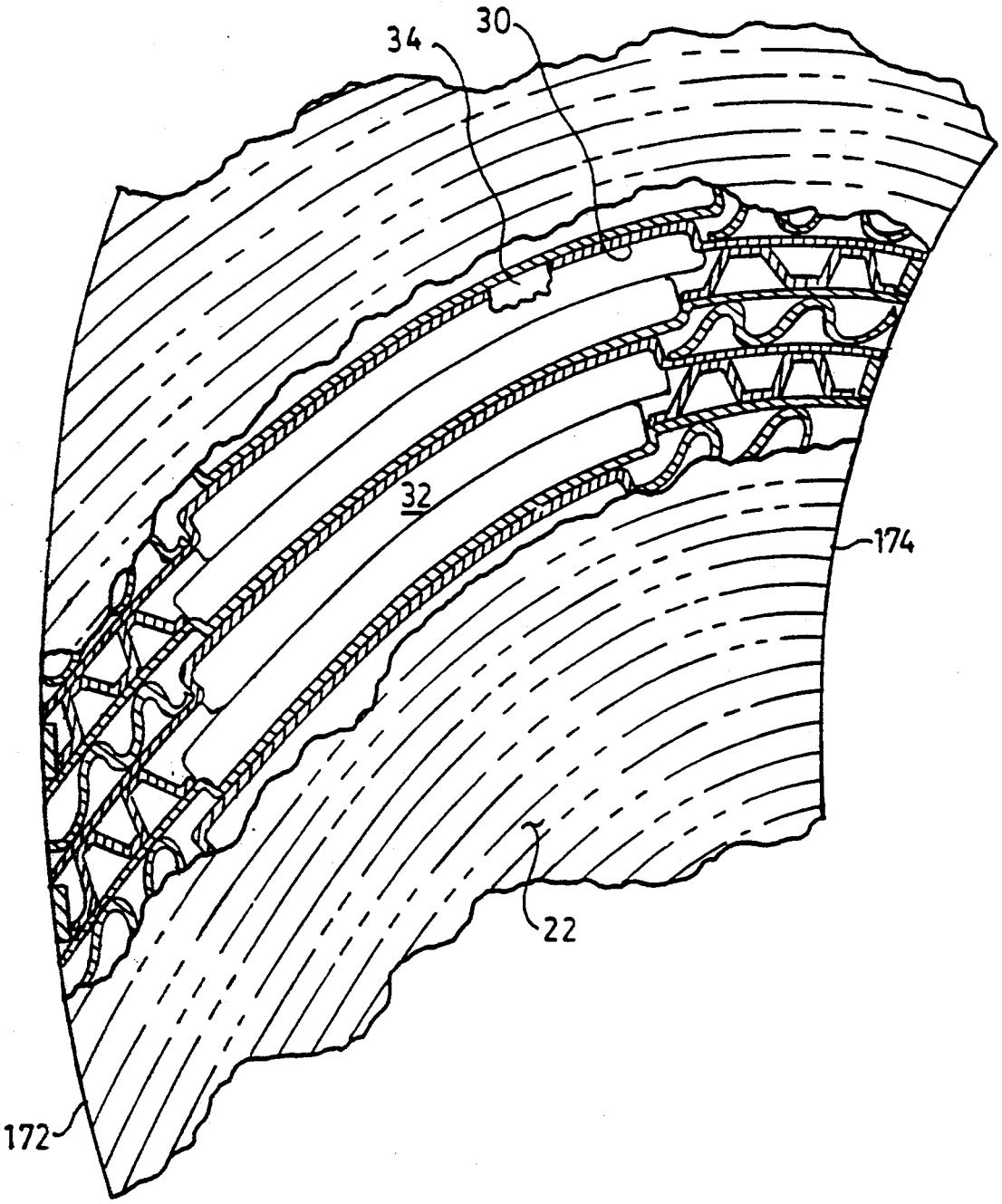
FIG. 5 is an enlarged sectional view through a plurality of cells taken along line 5—5 of FIG. 2.

Referring to the drawings, specifically FIGS. 1 and 2, a heat exchanger or recuperator 10 is attached to an engine 12. The engine 12 in this application is a gas turbine engine including an air intake system 14, only partially shown, having a recipient fluid, designated by the arrow 16. The engine 12 further includes an exhaust system 18, only partially shown, having a donor fluid, designated by the arrow 20. The temperature range of the recipient fluid 16 is lower than the temperature range of the donor fluid 20. As an alternative, the heat exchanger 10 could be used with any device having the recipient fluid 16 and the donor fluid 20 and in which heat transfer is desirable. The heat exchanger 10 includes a generally circular shaped core 22 being made of many pieces. The core 22 has a pair of ends 24 and 26, an inner portion 27 and an outer portion 28. The core 22 is generally centered about a central axis 29 and is removably attached to the engine 12. As best shown in FIG. 5, the core 22 is made up of a plurality of primary surface cells 30, each having a heat recipient passage 32 therein. A plurality of heat donor passages 34 are formed between adjacent cells 30 of the core 22. The cells 30 are stacked in contact with another one of the cells 30 and welded in place.

The heat exchanger 10 further includes means 38 for sealing the donor fluid 20 so that the donor fluid 20 passes through the core 22, and the recipient fluid 16 prior to entering the core 22 and after passing through the core 22. Further included is means 44 for distributing the recipient fluid 16 into the heat recipient passages 32. The means 44 for distributing the recipient fluid 16 includes a generally circular reservoir 46 positioned generally radially in line with the outer portion 28 of the core and generally axially external from the core 22. The reservoir 46 is positioned in fluid communication with the end 24. The heat exchanger 10 further includes means 50 for collecting the recipient fluid 16 after passing through the heat recipient passages 32. The means 50 for collecting the recipient fluid 16 includes a generally circular reservoir 52 positioned generally radially in line with the inner portion 27 of the core and generally axially external from the core 22. The reservoir 52 is positioned in fluid communication with the end 24. A housing 56, which in this application is a part of the heat exchanger 10 but as an alternative could be separate therefrom, partially surrounds the core 22. The housing 56 includes a generally cylindrical wrapper plate 60, an end plate 62 and a mounting adapter 64 for attaching to the engine 12 in a conventional manner. As an alternative, the mounting adapter 64 could be a part of the engine 12. A plurality of tie bolts 66 interconnect the end plate 62 and the mounting plate 64 adding further rigidity to the housing 56.

The gas turbine engine 12, which is only partially shown in FIGS. 1 and 2, is of a conventional design and includes a compressor section (not shown) through which clean atmospheric air, or in this application the recipient fluid 16, passes prior to entering the reservoir 46 and the core 22, a power turbine section (not shown) and the exhaust system 18, only partially shown, through which hot exhaust gases, in this application the donor fluid 20, pass prior to entering the core 22.

Figure 3:
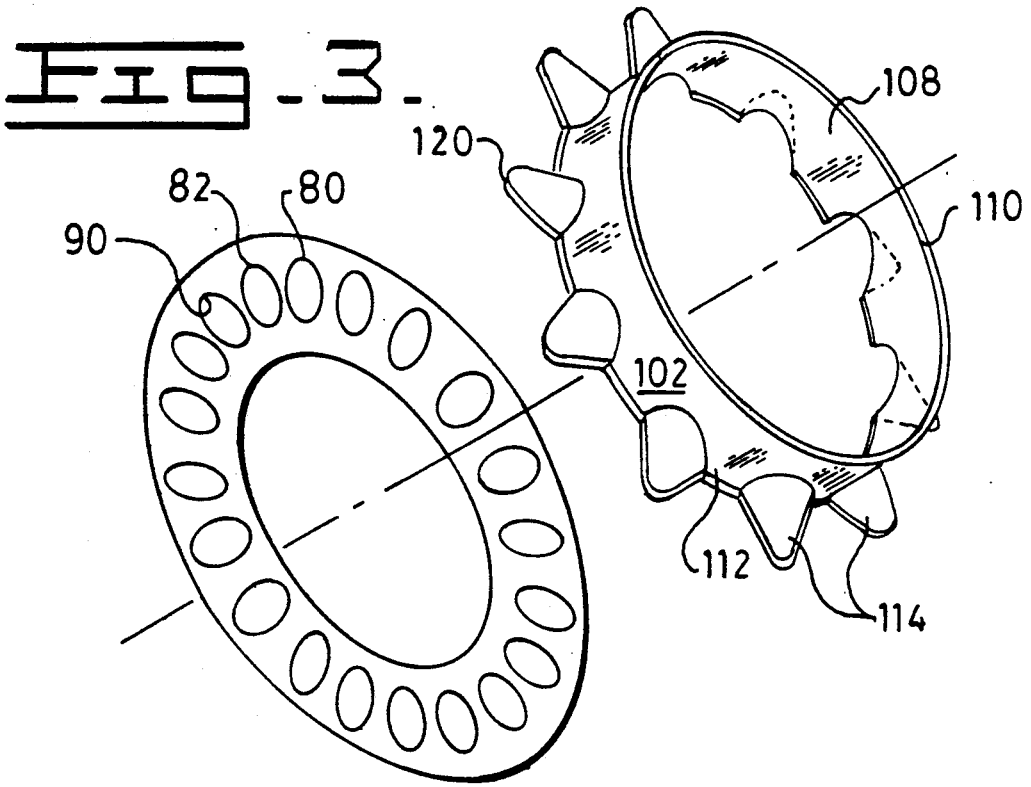
FIG. 3 is an exploded perspective view of a manifold and a seal carrier with a plurality of inlet and outlet ports shown within a circular band shown in phantom.

The air intake system 14, as partially shown in FIGS. 2 and 3, of the engine 12 further includes a plurality of inlet ports 80 and a plurality of outlet ports 82 therein through which the recipient fluid 16 passes. The inlet and outlet ports 80,82 are arranged in a generally circular band 84 (shown in phantom) centered about the central axis 29. Each of the inlet and outlet ports 80,82 are alternately positioned in the band 84.

As best shown in FIGS. 2 and 3, the means 38 for sealing includes a seal 98 positioned between the end 26 of the core 22 and the end plate 62. The sealing means 38 further includes a manifold 102. The manifold 102 has one end fixedly attached to the mounting adapter 64 or as an alternative could be attached directly to the engine 12. The other end is removably attachable in sealing contact with the core 22. At least a portion of the manifold 102 is interwoven between the plurality of inlet and outlet ports 80,82. The manifold 102 includes a generally cylindrical portion 108 having a pair of end portions 110,112. In this application, the cylindrical portion 108 includes a plurality of hyperbolic sleeve portions 114 which are die formed at the end portion 112 from an integral piece. As an alternative, the cylindrical portion 108 could be formed from individual components. For example, the cylindrical portion 108 would have a plurality of evenly spaced cutouts therein and the plurality of hyperbolic shaped sleeve portions 114 would be positioned about the cutouts and fixedly connected to the cylindrical portion 108 such as by welding. The end portion 112 of the cylindrical portion 108 is fixedly attached to the mounting adapter 64, such as by welding. The end portion 110 is removably attached to the core 22 in a tongue and groove configuration. For example, a pair of concentric cylinder members 116 are fixedly attached to the core 22. The pair of cylinder members 116 have a predetermined space or gap 117 therebetween so that the end portion 110 of the cylindrical portion 108 sealingly fits therein. The members 116 each have an end portion 118 which is bent or formed to provide a ramp so that the tongue 110 can easily be positioned into the groove 117. Experimentation has shown that to provide the best sealing arrangement an interference fit is required. For example, the space or gap 117 should be between about 0.20 mm and 0.30 mm smaller than the thickness of the tongue 110. In this specific application the space or gap 117 is about 0.25 mm smaller than the thickness of the tongue 110. Further experimentation has also shown that the depth of the engagement of the tongue 110 into the groove 117 does not substantially effect the sealing characteristics as greatly as does the relationship of the interference fit. In this application, however, the tongue 110 is inserted into the groove to an approximate depth of 12 mm. The tongue 110 and groove 117 combination also centers and positions the core 22. As an alternative, the tongue 110 which is also the end, could be a portion of the core 22 and the pair of concentric cylinder members 116 could be a part of the cylindrical portion 108. To further insure sealing in the tongue and groove joint, a seal 119 can be positioned in the space 117 between the pair of members 116 so that seal 119 contacts each of the pair of concentric cylinder members 116 and the end or tongue 110, thus, prevents leakage though the joint.

Figure 4:
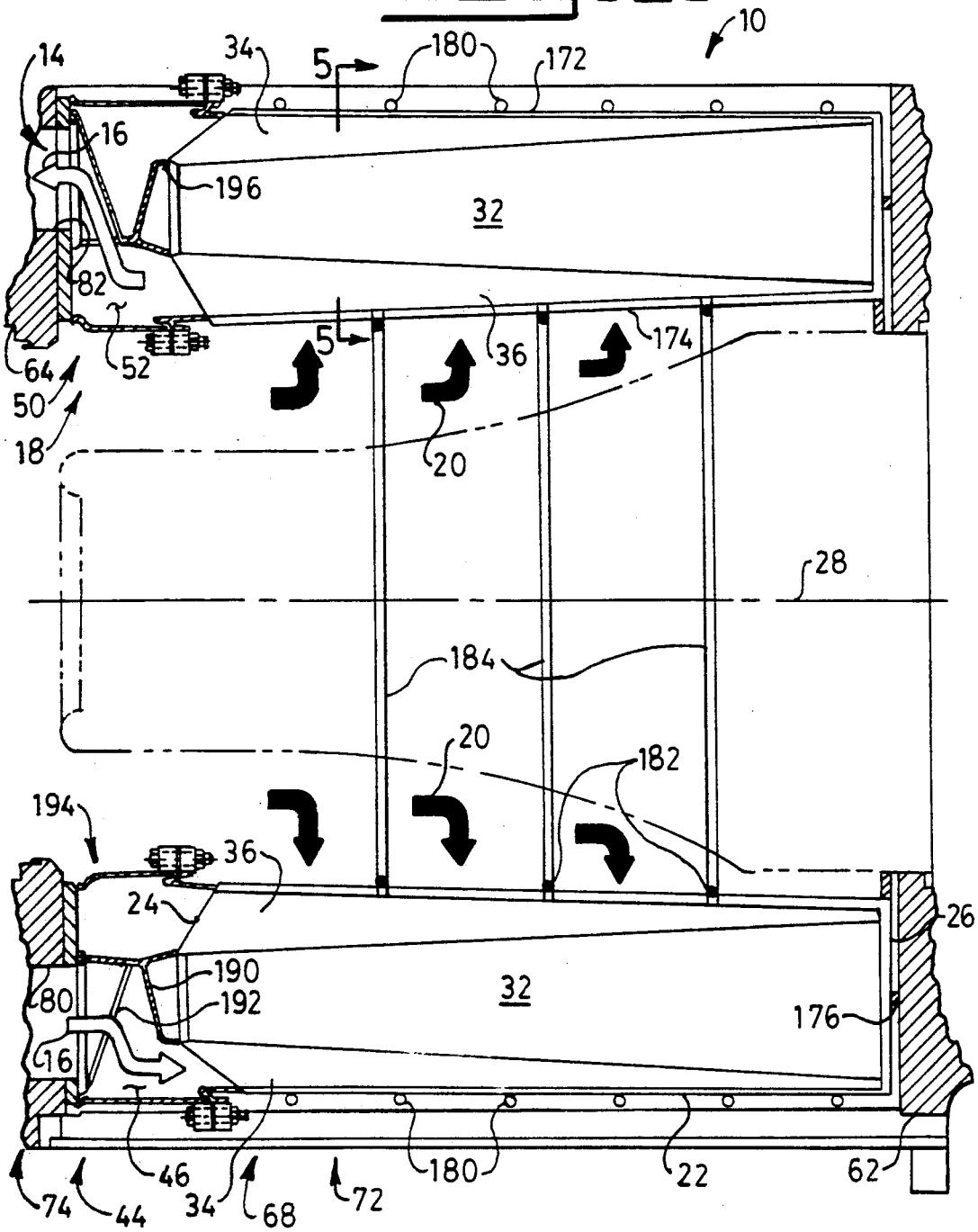
FIG. 4 is a sectional view of an alternate embodiment of a heat exchanger and a portion of the engine

As an alternative and shown in FIG. 4, the manifold 102 could be fixedly attached to the core 22 and removably attached to the mounting adapter 64 or the engine 12. The manifold 102 would include a seal carrier 120 having a generally channel shape including a base portion 122 fixedly attached to the hyperbolic shaped sleeve portions 114 and the remainder of the end 112. The seal carrier 120 further includes a pair of arms 124 extending from the base portion 122.

The means 38 for sealing the recipient fluid 16 further includes an apparatus 126 for surrounding the plurality of inlet and outlet ports 80,82. The apparatus 126 also seals between the exhaust system 18 and the intake system 14. The apparatus 126 includes an inner sealing portion 128 and an outer sealing portion 130. The inner sealing portion 128 and the outer sealing portion 130 act as means 131 for biasing the core 22 in sealing contact with the seal 98 between the core 22 and the end plate 62. The inner sealing portion 128 includes an inner annular guiding member 132 centered about the axis 29 and is attached to the mounting plate 64. An inner mounting flange 134 has a plurality of holes 136 therein and is fixedly attached to the member 132. An inner generally cylindrical member 138 which is a part of the inner sealing portion 128 is attached to the core 22. Further included in the sealing portion 128 is an inner annular guiding portion 140 attached to the generally cylindrical member 138. An inner annular fastening ring 142 is attached to the inner annular guiding portion 140 and has a plurality of holes 144 therein corresponding to the holes 136 in the inner mounting flange 134. An inner seal 146 is sealingly removably positioned between the inner mounting flange 134 and the inner annular fastener ring 142 by a plurality of fastener or bolt and nut combinations 148. The outer sealing portion includes an outer annular guiding member 150 external of the inner annular guiding member 132. The member 150 is attached to the mounting plate 64. An outer mounting flange 152 is attached to the outer annular guiding member 132 and has a plurality of holes 156 therein. The outer portion 132 further includes an outer generally cylindrical member 158 attached to the core 22. An outer annular guiding member 160 is attached to the outer generally cylindrical member 158. An outer annular fastening ring 162 which is a part of the outer portion 132 is attached to the outer annular fastening ring 162 and has a plurality of holes 164 therein corresponding to the holes 156 in the outer mounting flange 152. An outer seal 166 is sealingly removably positioned between the outer mounting flange 152 and the outer annular fastener ring 162 by a plurality of fastener or bolt and nut combinations 168.

Figure 7:
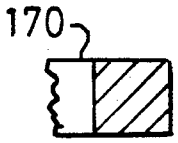
FIG. 7 is an enlarged cross-sectional view of the seal taken along line 7—7 of FIG. 6.
Figure 6:
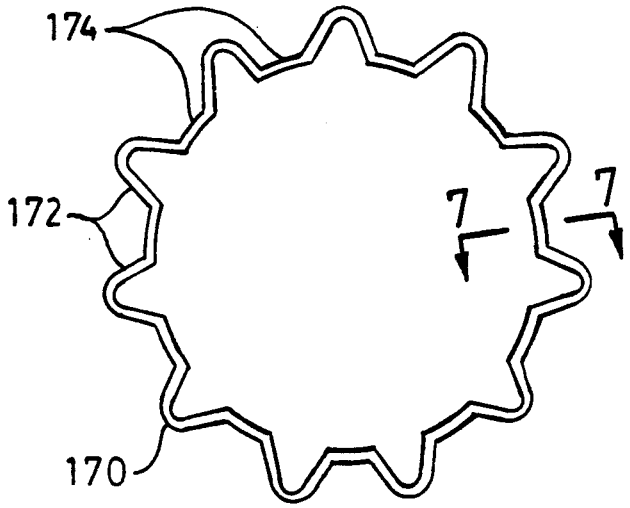
FIG. 6 is a side view of a continuous compressible seal.

If the alternate design as shown in FIG. 4 is used, the means 38 for sealing the recipient fluid 16 would further use a continuous seal 170, as best shown in FIGS. 6 and 7, having a generally rectangular cross-sectional shape. The seal 170 includes a continuous closed loop configuration having a plurality of hyperbolic shaped portions 172 and a plurality of equally spaced arcuate portions 174 interconnecting the plurality of hyperbolic shaped portions 172. The seal 170 is removably positioned in the seal carrier 120 between the mounting adapter 64 and the heat exchanger 10. The arms 124 extend partially around the seal 170. The arms 124 are in contacting relationship with the seal 170 and retain the seal in the carrier 120. In this application, the seal 170 is made of a compressible stainless steel spun fiber material and has a preestablished density so that the seal 170 can expand and contract with the thermal variations of the core 22.

Figure 8:
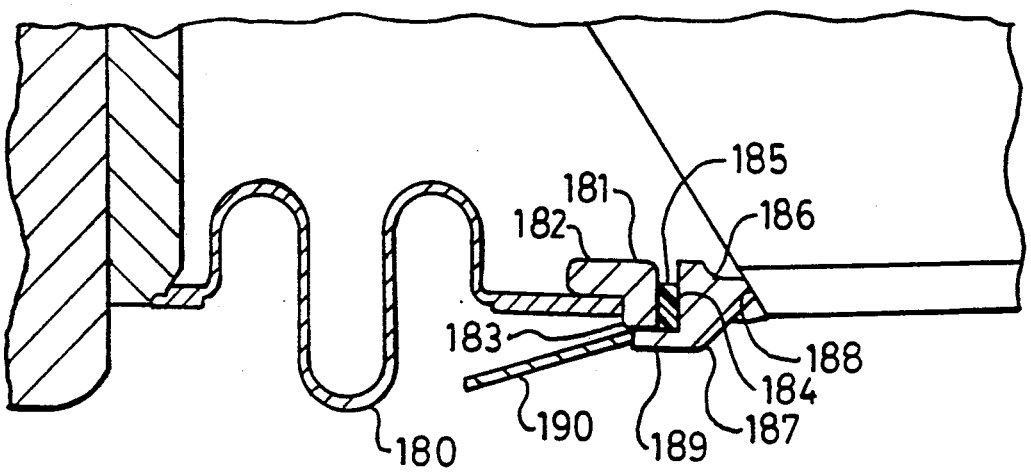
FIG. 8 is an enlarged cross-sectional view of an alternate embodiment of an inner sealing portion.

As an alternative and best shown in FIG. 8, the inner sealing portion 128 would include a generally cylindrical convoluted ring 180 having one end fixedly attached to the mounting adapter 64, such as by welding. The ring 180 would be centered about the axis 29 and would be positioned radially inward of the inlet and outlet ports 80,82. The other end of the ring 180 would have a cylindrical abutting member 181 attached thereto. The abutting member 181 has a generally "L" shaped cross-section including a long leg 182 and a short leg 183 having a sealing surface 184 thereon. The long leg 182 is attached to the ring 180 and the sealing surface 184 is in sealing contact with a continuous cylindrical seal 185. In this application the seal 185 is made of laminated graphite but could be of other materials and designs such as spun fiber, centered metal or copper. The seal 185 is positioned and retained in a holder 186 which is fixedly attached to the core 22. The holder 186 includes a body 187 having one end attached to the core 22, such as by welding and the other end has a portion thereof having a sealing surface 188 thereon. A cylindrical member 189 is attached at the end having the portion thereof having the sealing surface 188 thereon. A conical shaped cylindrical guiding member 190 is attached to the the cylindrical member 189 and guides the core 22 and the seal 185 into radial position so that the seal 185 and the sealing surface 184 are in sealing contact with each other.

Figure 9:
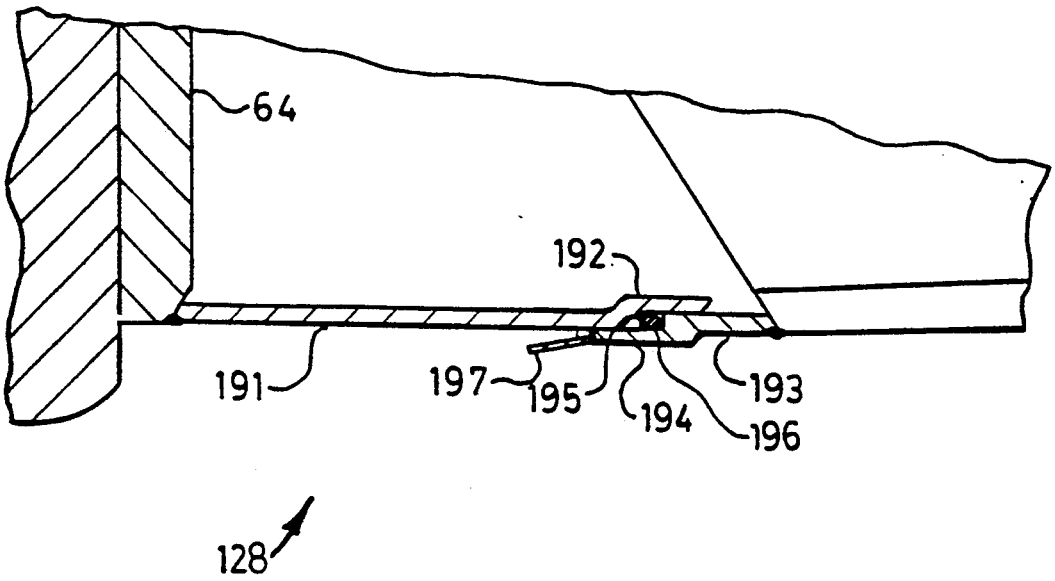
FIG. 9 is an enlarged cross-sectional view of an alternate embodiment of an inner sealing portion.

As another alternative and best shown in FIG. 9, the inner sealing portion 128 would include a first generally cylindrical member 191 having one end fixedly attached to the mounting adapter 64, such as by welding. The first cylindrical member 191 would have a lip portion 192 attached or formed at the other end. In this application, the lip portion 192 is formed radially outward of the first cylindrical member 191, but as an alternative could be attached or formed radially inward of the first cylindrical member 191. A second generally cylindrical member 193 having one fixedly attached to the core 22, such as by welding is also included in the inner sealing portion 128. The second generally cylindrical member 193 would have a lip portion 194 attached or formed at the other end. The lip portion 194 is formed radially inward of the second cylindrical member 193 so that when the first and the second generally cylindrical members 191,193 are axially positioned relative to each other, a pocket 195 is formed and a seal 196 is disposed therein. The lip portion 294 of the second generally cylindrical member 193 could be formed radially outward to conform to the lip portion 192 being formed radially inward on the first generally cylindrical member 193. The seal 196 can be made of a spun fiber, powered metal or carbon material. A conical shaped cylindrical guiding member 197 is attached to the lip portion 194 and guides the core 22 and the seal 196 into radial sealing position with the lip portion 192.

Figure 10:
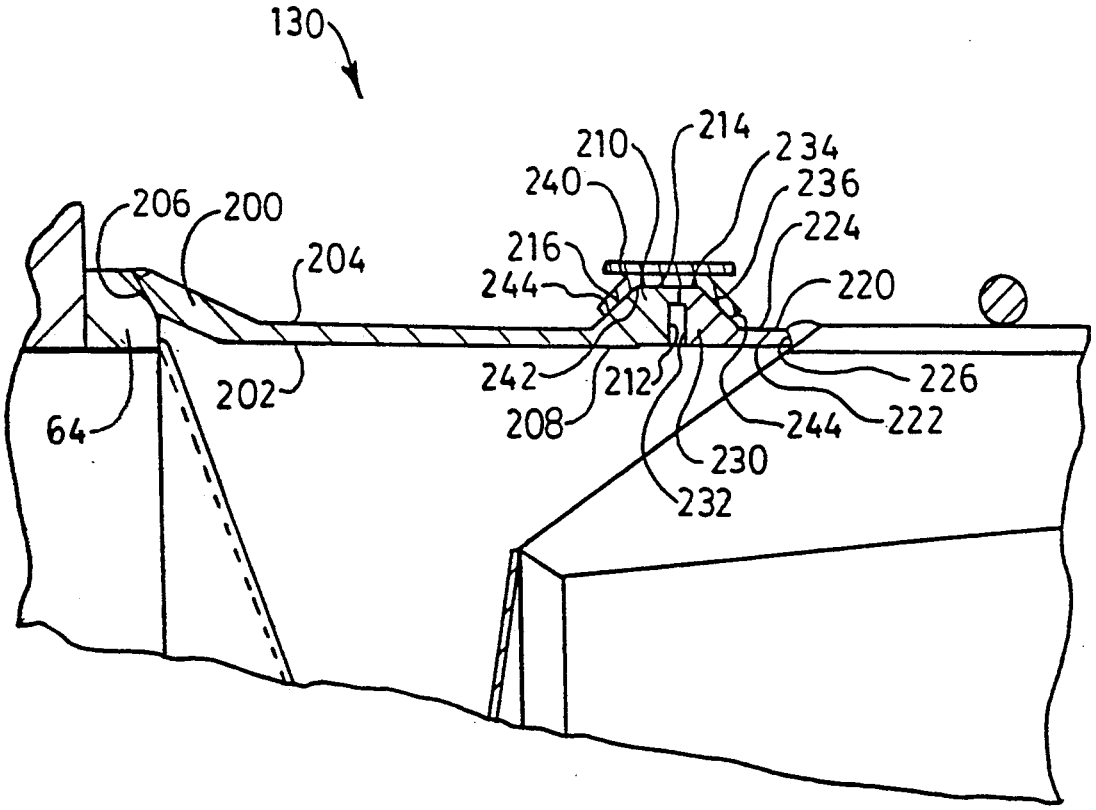
FIG. 10 is an enlarged cross-sectional view of an alternate embodiment of an outer sealing portion.

As an alternative and best shown in FIG. 10, the outer sealing portion 130 would be adapted to use a band type clamp. The outer sealing portion 130 would include a generally cylindrical ring 200 having an inner surface 202, an outer surface 204 and an end 206 fixedly attached to the mounting adapter 64, such as by welding. At the other end, an end portion 208 would be configured to conform a portion of a band type clamp. For example, the end 208 would include a raised portion 210 having a sealing surface 212 extending outwardly a preestablished distance from the inner surface 202 and being substantially perpendicular to the inner surface 202. A top surface 214 extends axially away from the surface 212 a preestablished distance and substantially perpendicular to the sealing surface 212. A wedge surface 216 extends between the top surface and the outer surface 204 at a preestablished angle, which in this application is approximately 45 degrees. The outer sealing portion 130 further includes a generally cylindrical ring 220 having an inner surface 222, an outer surface 224 and an end 226 fixedly attached to the core 22, such as by welding. At the other end, an end portion 228 would be configured to conform a portion of a band type clamp. For example, the end portion 228 would include a raised portion 230 having a sealing surface 232 extending outwardly a preestablished distance from the inner surface 222 and being substantially perpendicular to the inner surface 222. A top surface 234 extends axially away from the surface 232 a preestablished distance and substantially perpendicular to the sealing surface 232. A wedge surface 236 extends between the top surface 234 and the outer surface 224 at a preestablished angle, which in this application is approximately 45 degrees. A split band or clamp 240 would be used to frictionally attach the raised portion 210 to the raised portion 230. The clamp 240 includes a generally cylindrical center portion 242 and a pair of conically shaped end portions 244, one of each conically shaped end portions 244 being formed generally inward and forming a generally channel shaped cylindrical structure. The clamp 240 is secured by means 240 for securing. The means 240 for securing is of a conventional construction and may as an alternative include an over-center pivot mechanism or a pair of abutting members attached by a fastener mechanism, neither of which are shown. To insure sealing between the raised portions 210 and 220 a continuous circumferential seal 246 is positioned between the sealing surface 212 and 232. The conical shaped end portions 244 exert an axial force on the wedge surfaces 216 and 236 to force the sealing surfaces 212 and 232 into contact with the seal 246.

As best shown in FIG. 2, the means 38 for sealing has a portion thereof adapted to seal the exhaust system 18 so that the donor fluid 20 passes through the heat exchanger. The components doing the sealing are the inner sealing portion 128, the outer sealing portion 130, the wrapper plate 60, the end plate 62 and the seal 98.

Industrial Applicability

The compressor section of the conventional gas turbine engine 12 compresses atmospheric air or recipient fluid 16 prior to passing through the heat recipient passages 32 of the heat exchanger 10. Exhaust gases or donor fluid 20 from the combustion in the engine 12 pass through the heat donor passages 40 of the heat exchanger 10 and thermally heat the recipient fluid 16 in the heat exchanger 10 prior to reentering the engine 12. The recipient fluid is then mixed with fuel, combusted and exhausted as the donor fluid 20. Thus, during operation of the engine 12 a continuous cycle occurs.

When the engine 12 is used in a vehicular application, the cyclic operation of the engine 12 causes the exhaust gas temperature to increase and decrease. Furthermore, the intake air and the exhaust gas volume and pressure vary depending on the cyclic operation. Thus, thermal stress and structural integrity of the heat exchanger and the sealing components are stressed to the ultimate.

The core 22 is removably attached to the engine 12. The end 112 of the cylindrical portion 108 is fixedly attached to the mounting adapter 64. The pair of concentric cylinders 116 are positioned about the tongue or end 110. The end 26 of the core 22 is positioned with the seal 98 in contact with the end plate 62. For example, the end 110 is slidably in sealing contact with the pair of concentric cylinders 116. Thus, the core 22 is free to move axially between the cylindrical portion 108 and the end plate 62. The plurality of holes 144 in the inner annular fastening ring 142 are aligned with the plurality of holes 136 in the inner mounting flange 134, and the seal 146 is positioned between the inner annular fastening ring 142 and the inner mounting flange 134. The ring 142, the flange 134 and the seal 146 are fastened together by the plurality of fasteners 148. Additionally, the plurality of holes 164 in the outer annular fastening ring 162 are aligned with the plurality of holes 156 in the outer mounting flange 152, and the seal 166 is positioned between the outer annular fastening ring 162 and the outer mounting flange 152. The ring 162, the flange 152 and the seal 166 are fastened together by the plurality of fasteners 168. Thus, the heat exchanger 10 is assembled in functional operating relationship to the engine 12. The exhaust gases or donor fluid 20 exit the engine 12, enter the donor passage 34 of the heat exchanger 10 and the individual primary surface pleated sheets are heated by the hot exhaust 20. At the same time, compressed air or recipient fluid 16 exits the plurality of outlet ports 82, enters the circular reservoir 46 and is directed to the plurality of recipient passages 32. The recipient fluid 16 is heated in the recipient passages 32 and is directed into the circular reservoir 52. From the circular reservoir 52 the heated recipient fluid 16 reenters the engine 12 through the plurality of inlet ports 80. The recipient fluid 16 is mixed with fuel and combusted in the engine 12 increasing the efficiency of the engine 12.

Thus, the tongue 110 and groove 117 which is biasedly positioned between the core 22 and the engine 12 and the portion of the sealing means 38 adapted to seal the intake system 14 from the exhaust system 18, insures that the recipient fluid 16 passes through the heat recipient passage 32 of the heat exchanger 10. Furthermore, the portion of the means 38 adapted to seal the exhaust system 18 insures that the donor fluid 20 is circulate through the heat exchanger 10. The biasing means 131 further insures that the seal 98 is in sealing contact between the core 22 and the end plate 62. The tongue 110 and groove 117 further insures that the cooler recipient fluid 16 is separated from the heated recipient fluid 16. The construction of the tongue 110 and groove 117 being an interference fit accomplishes the sealing since the tongue 110 is in friction engagement with each of the cylindrical member 116.

Other aspects, objects and advantages will become apparent from a study of the specification, drawings and appended claims.

I claim:

1. A heat exchanger adapted for use in an engine including an exhaust system having a donor fluid as a part thereof, an air intake system having a recipient fluid as a part thereof, the heat exchanger disposed in fluid communication with the exhaust system and the air intake system and including a core having a plurality of heat recipient passages and a plurality of heat donor passages therein, and a housing surrounding the core, said heat exchanger comprising:

said core being generally circular, having a central axis and when installed being removably attachable to the engine; and means for sealing the donor fluid so that the donor fluid passes through the core, and further sealing the recipient fluid prior to entering the core and after passing through the core, said means for sealing when installed being attachable between the engine and the core, and said means for sealing including a tongue, and a groove being formed between a pair of generally concentric cylinder members, one of said tongue and said members being fixedly attached to the core and the other one of the tongue and the members being attached to the engine when installed.

2. The heat exchanger of claim 1 wherein said tongue is attached to the core.

3. The heat exchanger of claim 1 wherein said means for sealing further includes a seal positioned in the groove.

4. The heat exchanger of claim 3 wherein said seal is in sealing contact with each one of the generally cylindrical members and the tongue.

5. The heat exchanger of claim 1 wherein said tongue is in contacting relationship with at least one of said generally cylindrical members.

6. The heat exchanger of claim 1 wherein said tongue is in contacting relationship with each of said generally cylindrical members.

7. The heat exchanger of claim 1 wherein said means for sealing further includes an apparatus for surrounding the plurality of inlet and outlet ports.

8. The heat exchanger of claim 7 wherein said apparatus includes an inner sealing portion and an outer sealing portion.

9. The heat exchanger of claim 8 wherein said inner sealing portion and said outer sealing portion removably attach the core to the housing by using a plurality of fasteners.

10. The heat exchanger of claim 8 wherein said inner sealing portion and said outer sealing portion biasingly attach the core to the housing.

11. The heat exchanger of claim 10 wherein said inner sealing portion includes a convoluted ring fixedly attached to one of the core and the mounting adapter and an abutting member attached to the other of the core and the mounting adapter.

12. The heat exchanger of claim 11 wherein said inner sealing portion further includes a sealing surface being attached to each of the convoluted ring and the abutting member.

13. The heat exchanger of claim 12 wherein said inner sealing portion further includes a seal positioned in sealing relationship to the sealing surfaces.

14. The heat exchanger of claim 8 wherein said inner sealing portion includes a first and second cylindrical member attached to one of the core and the mounting adapter, each of said first and second cylindrical members having a lip portion attached thereto.

15. The heat exchanger of claim 14 wherein said lip portions when axially positioned relative to each other form a pocket therebetween.

16. The heat exchanger of claim 15 wherein a seal is positioned in the pocket.

17. The heat exchanger of claim 8 wherein said outer portion includes a pair of generally cylindrical rings fixedly attached to one of the core and the mounting adapter, each of said generally cylindrical rings including an end portion each having a wedge surface and a clamp removably attaching the end portions in sealing relationship.

18. The heat exchanger of claim 17 wherein said outer portion further includes a sealing surface attached to each of the end portions.

19. The heat exchanger of claim 18 wherein a seal is positioned between the sealing surfaces.

20. A heat exchanger adapted for use in an engine including an exhaust system having a donor fluid as a part thereof, an air intake system having a recipient fluid as a part thereof, the heat exchanger disposed in fluid communication with the exhaust system and the air intake system and including a core having a plurality of heat recipient passages and a plurality of heat donor passages therein, and a housing surrounding the core, said heat exchanger comprising:

said core being generally circular, having a central axis and when installed being removably attachable to the engine; and means for sealing the donor fluid so that the donor fluid passes through the core, and further sealing the recipient fluid prior to entering the core and after passing through the core, said means for sealing when installed being attachable between the engine and the core, and said means for sealing including a manifold having an end fixedly attached to the core and the other end attachable in sealing contact with the housing when installed.

21. The heat exchanger of claim 20 wherein said air intake system includes a plurality of inlet ports for the recipient fluid and a plurality of outlet ports for the recipient fluid, said plurality of inlet and outlet ports are arranged in a generally circular band centered about the central axis and each of the inlet ports and each of the outlet ports are alternately positioned in the band, said end of the manifold being removably attachable in sealing contact between the housing and the core, at least a portion of said manifold being interwoven between the plurality of inlet and outlet ports.

22. The heat exchanger of claim 21 wherein said manifold further includes a continuous seal interwoven between the plurality of inlet and outlet ports.

23. The heat exchanger of claim 22 wherein said portion of said manifold interwoven between the plurality of inlet and outlet ports is welded to the housing.

24. The heat exchanger of claim 22 wherein said manifold further includes a cylindrical portion having a plurality of arcuate portions having a common radius and a plurality of hyperbolic portions connected therebetween.

25. The heat exchanger of claim 24 wherein said arcuate portions and said hyperbolic portions are evenly spaced therebetween.

* * * * *